US010344955B2

(12) United States Patent
Avery et al.

(10) Patent No.: US 10,344,955 B2
(45) Date of Patent: Jul. 9, 2019

(54) DYNAMIC LIGHT DISPLAY FRAME

(71) Applicants: Richard Monroe Avery, Magnolia, TX (US); Benjamin Franklin Avery, Magnolia, TX (US)

(72) Inventors: Richard Monroe Avery, Magnolia, TX (US); Benjamin Franklin Avery, Magnolia, TX (US)

(73) Assignee: AVERY BUSINESS GROUP INC., Harker Heights, TX (US)

( * ) Notice: Subject to any disclaimer, the term of this patent is extended or adjusted under 35 U.S.C. 154(b) by 0 days.

(21) Appl. No.: 15/292,231

(22) Filed: Oct. 13, 2016

(65) Prior Publication Data

US 2018/0073708 A1 Mar. 15, 2018

Related U.S. Application Data

(60) Provisional application No. 62/240,927, filed on Oct. 13, 2015.

(51) Int. Cl.

| | |
|---|---|
| ***F21V 21/08*** | (2006.01) |
| ***F21V 21/088*** | (2006.01) |
| ***F21V 21/22*** | (2006.01) |
| *F21Y 103/20* | (2016.01) |
| *F21W 121/00* | (2006.01) |

(52) U.S. Cl.

CPC ..... *F21V 21/088* (2013.01); *F21V 21/22* (2013.01); *F21W 2121/00* (2013.01); *F21Y 2103/20* (2016.08)

(58) Field of Classification Search

CPC .... F21V 19/0045; F21V 21/043; F21V 21/12; F21V 21/22; F21V 21/088; F21S 4/15; F21S 4/20; F21S 4/22; F21S 4/28; F21S 8/038; F21S 8/043; F21S 8/046; F21Y 2103/20

USPC ..... 362/396

See application file for complete search history.

(56) References Cited

U.S. PATENT DOCUMENTS

| | | | | |
|---|---|---|---|---|
| 3,098,611 A * | 7/1963 | Connell | G09F 13/00 160/374 |
| 4,995,181 A * | 2/1991 | Wolf | A47G 1/0622 206/223 |
| 5,707,136 A * | 1/1998 | Byers | F21V 3/02 362/145 |
| 6,651,944 B2 * | 11/2003 | Coleman | F16M 11/34 248/163.1 |
| D624,671 S * | 9/2010 | Greene | D26/25 |

* cited by examiner

*Primary Examiner* — Matthew J. Peerce

(57) ABSTRACT

A dynamic light display frame that is a specialty manufactured plastic frame using lockable telescoping sides and an inset track for temporary bulb fixation by utilizing strut spacing and materials for friction creation. This inset track system can be modified during manufacturing to accept numerous bulb bases for a variety of intended uses. This track holds the light bulb base spacing and position thereby providing for maximal aesthetic presentation of lighting.

11 Claims, 8 Drawing Sheets

DYNAMIC LIGHT DISPLAY FRAME

CROSS-REFERENCE TO RELATED APPLICATIONS

This application claims priority to U.S. Provisional Patent Application having Ser. No. 62/240,927, which was filed Oct. 13, 2015. This priority application is hereby incorporated by reference in its entirety into the present application to the extent consistent with the present application.

BACKGROUND

Traditionally, hanging holiday lighting requires significant effort, as individual light strings must be hung around each feature desired to be highlighted by the lights. For example, it is popular to string holiday lights around windows to outline the rectangular shape of the windows. This requires securing the lights at each of the four corners of the window and running the strings between the securing points to outline the window. However, this requires significant effort, and further, does a poor job of aligning the lights so that a neat appearance is created. Further, both the installation and removal of the lights requires significant effort for each window.

Therefore, there is a need for a holiday light hanging device that would allow a user to hang a plurality of lights around a feature, such as a window, where in the installation and removal process requires minimal effort, and further, wherein the lights are maintained in a symmetric and linear fashion so that they create a neat appearance around the feature.

SUMMARY

Embodiments of the disclosure generally provide a dynamic light display frame that is a specialty manufactured plastic frame using lockable telescoping sides and an inset track for temporary bulb fixation by utilizing strut spacing and materials for friction creation. This inset track system can be modified during manufacturing to accept numerous bulb bases for a variety of intended uses. Due to the flexibility of the channels, the light frame of the present disclosure will accommodate at least mini lights, C3, C6, C7 and C9 LED lights with a traditional wedge shaped socket base. Further the frame is adaptable via clip on adapters that fit in the tract which will make the system compatible with essentially any style of light socket.

Embodiments of the disclosure may provide a light frame assembly for securing decorative lighting thereto, wherein the light frame assembly includes four corner members and four side member assemblies, the assemblies comprising an alternating combination of outer channel members and inner channel members, wherein terminating ends of the inner channel members are slidably received into first terminating ends of the outer channel members and wherein second terminating ends of the outer channel members are slidably engaged with corner members. The light frame assembly further includes a clamp shaped to slide over the outer channel member having an inner channel member slidably received therein, and a clamp screw configured to secure the clamp to the outer channel member and thereby secure the inner and outer channel members together.

Embodiments of the disclosure may further provide a light frame assembly that has four corner members, a plurality of outer channel members, and a plurality of inner channel members forming horizontal and vertical elongated sides of the light frame assembly, the outer channel members having a hollow inner portion sized to slidably receiving the inner channel members therein. The light frame assembly may further provide eight terminating ends of the outer channel members being connected to the four corner members, and a plurality of clamping members positioned around an outer portion of the outer channel member and being secured thereto by a threaded screw, the threaded screw causing the outer channel member to frictionally engage the inner channel member to prevent slidable movement between the outer and inner channel members.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

Paragraph

DETAILED DESCRIPTION

Figure 1:
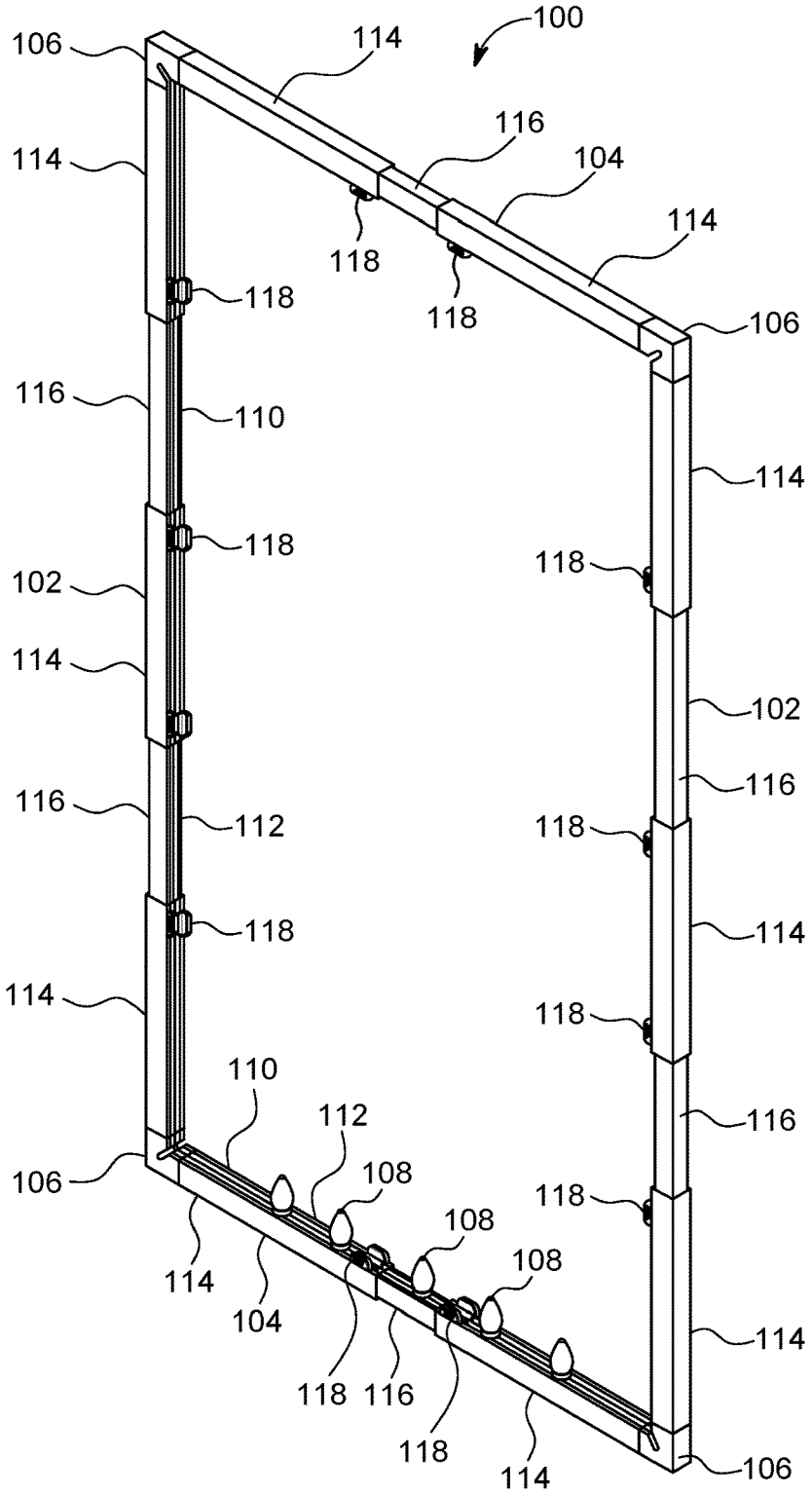
FIG. 1 illustrates a perspective view of the light frame of the invention.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. Further still, various directional terms such as inner, outer, up, down, etc. are used throughout the specification. These terms are intended to be exemplary and not limiting up on the scope of the invention, as the invention may be viewed from various perspectives, and the orientations may vary from embodiment to embodiment without departing from the scope of the invention.

FIG. 1 illustrates a perspective view of the light frame 100 of the invention. The light frame 100 is generally configured as a rectangle with vertical sides 102 and horizontal sides 104. Each of the vertical and horizontal sides 102, 104 are made up of corner members 106 and a plurality of longitudinally extending or telescoping members connecting therebetween. The light frame 100 when assembled is configured to receive a plurality of lights 108 on or within an inwardly facing surface or channel 110 of the light frame 100. The inwardly facing surface/channel 110 extends around the entire perimeter of the light frame 100, thus allowing for lights to be placed around the entire light frame 100. Light frame 100 may be generally manufactured from a C-shaped channel or a U shaped channel, where in the open portion of the channel is positioned to face either inwardly (toward the center axis of the rectangle) or outwardly (away from the center axis of the rectangle), or in another embodiment of this disclosure, the channel may face parallel to the center axis of the rectangle. In the present embodiment, the channel, which is also called the light receiving channel 112, is shown facing inwardly toward the center axis of the rectangle. The lights 108 along with the associated wire connecting the lights may be inserted into the light receiving channel 112 and secured therein for display by the light frame 100.

Each of the vertical sides 102 and horizontal sides 104 are made up of a plurality of channel members. For example, the vertical sides 102 may include alternating outer channel members 114 and inner channel members 116 positioned between two corners 106. The outer channel members 114 may be configured to engage and secure to the corners 106, as will be further discussed herein with respect to FIGS. 8 and 9. Proceeding away from a corner 106 through an outer channel member 114, then each of the sides 102 next includes an inner channel member 116. The inner channel members 116 are shaped and configured to be slidably received within the outer channel member 114. Then an opposing end of the inner channel member 116 may be received within another outer channel member 114, thus creating an elongated channel member that is slidable or telescopically movable to vary the overall length thereof.

For example, the vertical sides 102 of the current light frame 100 include a corner 106, a first outer channel member 114 connected to the corner 106. The end opposite corner 106 of outer channel member 114 slidably receives a first inner channel member 116 therein. The opposite end of the first inner channel member 116 may be received in a second outer channel member 114. Then the opposing end of the second outer channel member 114 may have a second inner channel member 116 slidably received therein. The opposing end of the second inner channel member 116 may again be slidably received into a third outer channel member 114, and the opposing end of the third outer channel member 114 may be secured to a corner 106. This combination of inner and outer channel members 114, 116 being slidably received within each other creates a unitary elongated channel that is slidably adjustable to create a variety of desired lengths. The same type of alternating positioning of outer channel members and inner channel members 114, 116 may be used to create the horizontal sides 104. Thus, the end result will be for corners 106 having a plurality of alternating outer and inner channel members 114 116 positioned between each of the corners to form sides. The resulting rectangular light frame 100 is adjustable in both length and height to a plurality of desired lengths by simply slighting the outer and inner channel members with respect to each other to create longer or shorter sides 102, 104 as desired.

Figure 2:
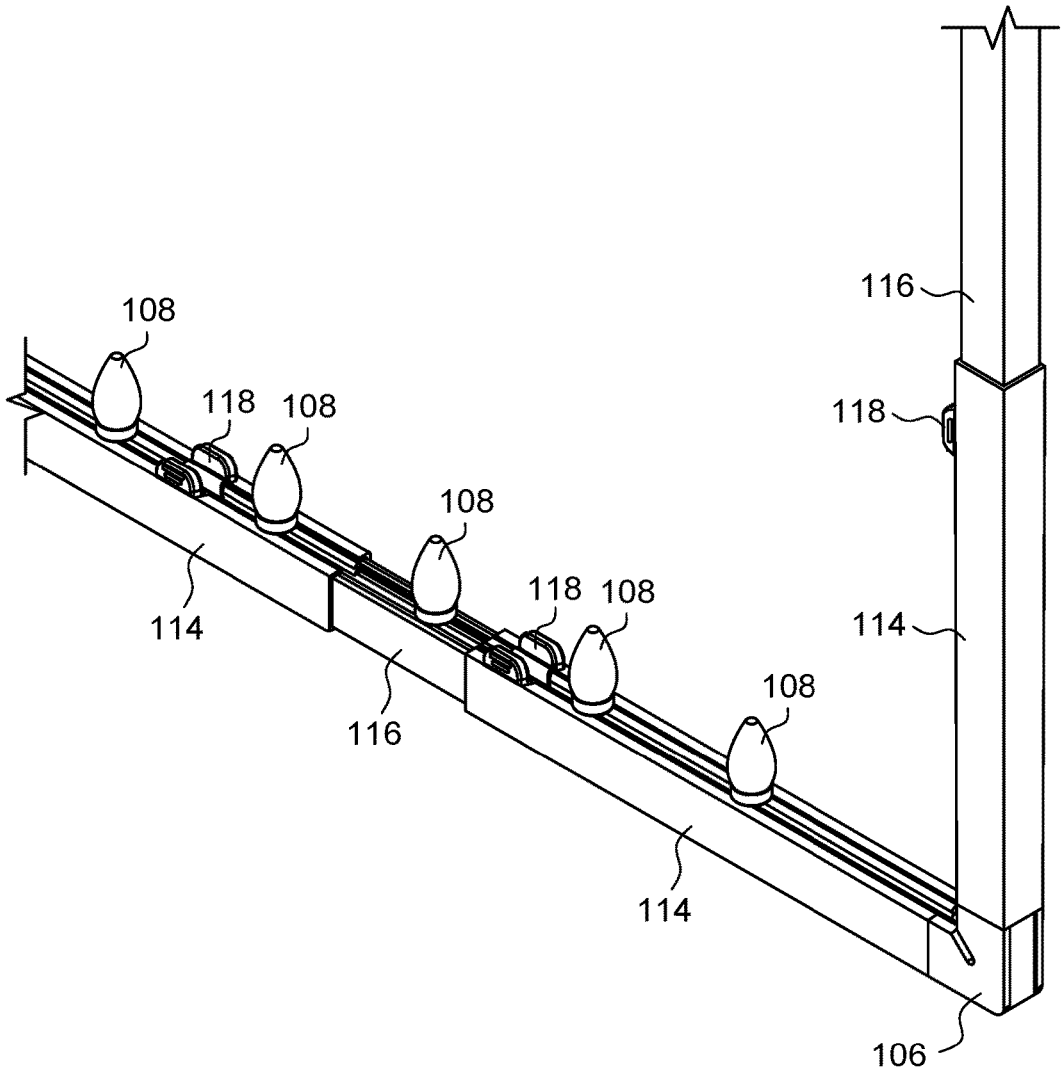
FIG. 2 illustrates a perspective view of one corner and the associated components of the light frame of the invention.
Figure 8:
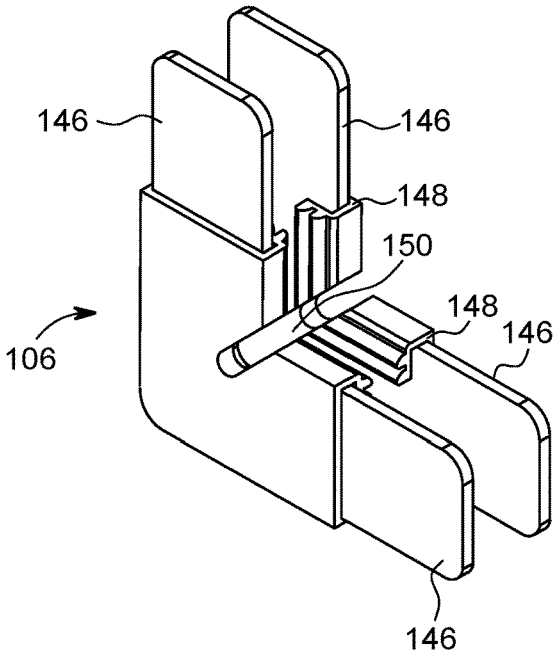
FIG. 8 illustrates a corner member used to secure a corner of the light frame of the invention.

FIG. 2 illustrates a perspective view of one corner 106 and the associated components of the light frame 100. The corner 106, as shown in greater detail in FIG. 8, is configured to frictionally engage the outer channel member 114 and secure thereto. The outer channel members are configured to slidably engage inner channel members 116 to create the elongated sides 102, 104. The respective sides 102, 104 may be made essentially any length by increasing or decreasing the number of alternating outer and inner channel members 114, 116. In the current embodiment the only restriction on the number of members 114, 116 used to form a side 102, 104 is that the terminating ends of the side 102, 104 must be outer channel members 114 as the corner 106 is configured to engage the outer channel members 114. In an alternative embodiment, the corner member 106 may be configured to engage either of the outer channel member 114 and/or the inner channel member 116.

Once the combination of outer and inner channel members 114, 116 are slidably positioned together to form the desired length, the respective outer and inner channel members 114, 116 may be secured together by a securing tab 118. As further described with respect to FIG. 6, the securing tab 118 is generally received in the light receiving channel 112 at a position in the side 102, 104 where the outer channel member 114 and the inner channel member 116 are overlapping. The securing tab 118 is used to mechanically bias the inner channel member 116 outward toward the outer channel member 114. Thus, generally speaking, an outer surface of the inner channel member 116 will frictionally engage an inner surface of the outer channel member 114. This frictional engagement prevents further slidable movement between the outer channel member and the inner channel member 114, 116. Thus, the securing tab operates two secure their respective channel members 114, 116 together so that they cooperatively form a desired fixed length. The lights 108 may be inserted into the light receiving channel 112 that is formed by the combination of the longitudinally extending outer channel members 114 and inner channel members 116. The wire interconnecting the respective lights 108 may also be stowed in the light receiving channel 112, as further described herein with respect to FIG. 7.

Figure 3:
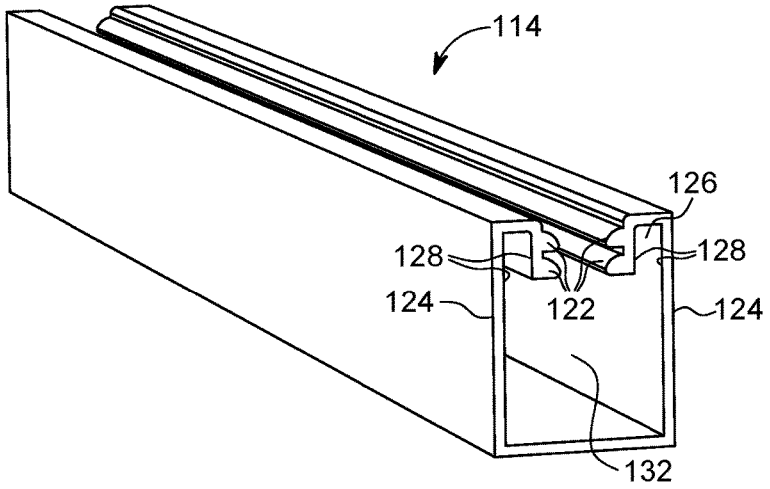
FIG. 3 illustrates a cross-sectional perspective view of an outer channel member of the invention.

FIG. 3 illustrates a detailed cross-sectional perspective view of an outer channel member 114. The outer channel member 114 generally includes an elongated and generally C-shaped or U-shaped channel that forms a hollow inner channel portion 132. Surrounding the inner channel portion 132 there are generally upstanding walls 124 connected to a base that cooperatively forms the sides of the channel portion 132. The open end of channel 132 includes a plurality of light engaging or gripping members 122. The light gripping members 122 are oppositely positioned to face each other so that a light 108 may be received therebetween and secured in the received position.

In the current exemplary embodiment, an upper portion of the outer channel member 114 also includes a second U-shaped engaging channel 126 that faces downward or generally in the opposite direction of channel 132. The second engaging channel 126 may be used to receive and align the slidable engagement between the outer channel member 114 and the inner channel member 116. Furthermore, the second engaging channel 126 includes engaging surfaces 128 that are configured to frictionally engage surfaces on the inner channel member 116 to secure the respective channel members 114, 116 together when the biasing force created by the securing tab 118 is applied thereto.

Figure 4:
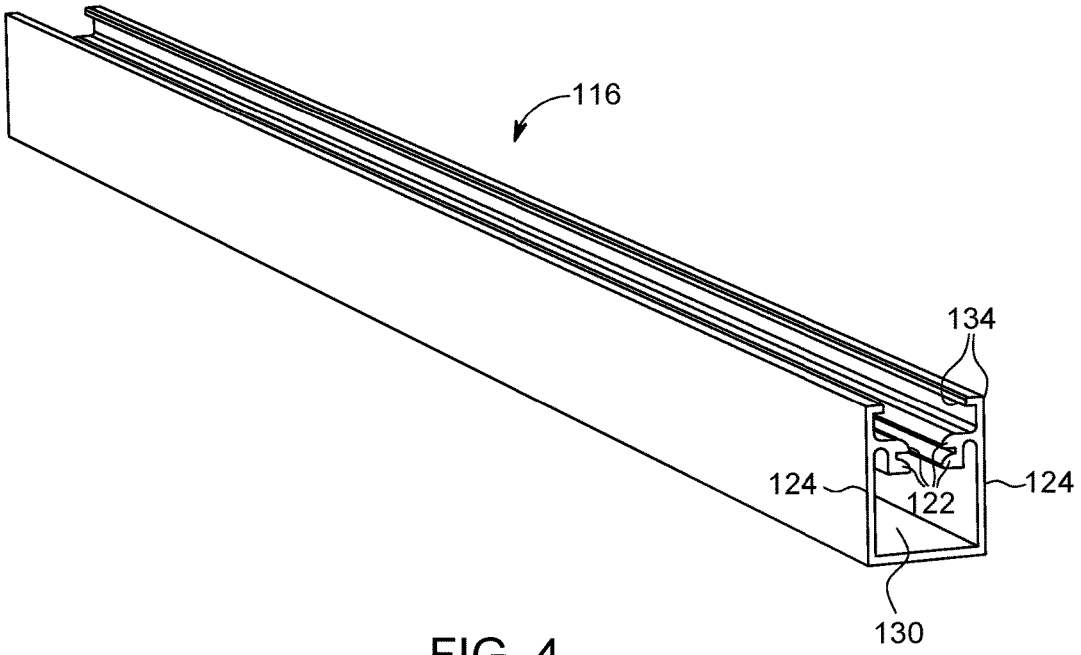
FIG. 4 illustrates a cross-sectional perspective view of an inner channel member of the invention.

FIG. 4 illustrates a cross-sectional perspective view of an inner channel member 116. The inner channel member 116 also includes upstanding outer walls 124 connected to a base that cooperatively form a hollow inner channel portion 130. The channel 130 also includes the light engaging or gripping members 122 positioned opposite the base of the channel 130, the light gripping members 122 again being positioned opposite or facing each other so as to receive a light 108 therebetween and secure it in the received position. The upper portion of the inner channel member 116 also includes an engaging surface 134, wherein the engaging surface 134 is configured to slidably engage the engaging surface 128 of the outer channel member 114. When the securing tab 118 is inserted into the light receiving channel 112 and released, the securing tab 118 exerts an outwardly directed biasing force that causes the upstanding walls 124 of the inner channel member 116 to be urged outwardly toward the upstanding walls 124 of the outer channel member 114.

Generally, the walls 124 of the inner channel member are flexible enough to allow bending or movement of the respective walls 124 in response to a biasing force. This flexing or movement allows the walls 124 of the inner channel member 116 to move and press against the walls 124 of the outer channel member 114 when the inner channel member 116 is slidably positioned within the outer channel member 114. This pressing against generally occurs at the engaging services 128 and 134 when the biasing force of the securing tab 118 is applied to the inner channel member 116. The frictional engagement between the respective engaging surfaces 128, 134 causes the respective channel members 114, 116 to be fixed with respect to each other (slidable engagement is generally restricted). Further, the light engaging or gripping members 122 of the inner channel member 116 are positioned immediately below the light engaging or gripping members 122 of the outer channel member 114. Thus, the light engaging or gripping members 122 of both channel members 114, 116 are positioned immediately above/below each other and will operate to cooperatively receive and secure a light 108 therebetween.

Figure 5:
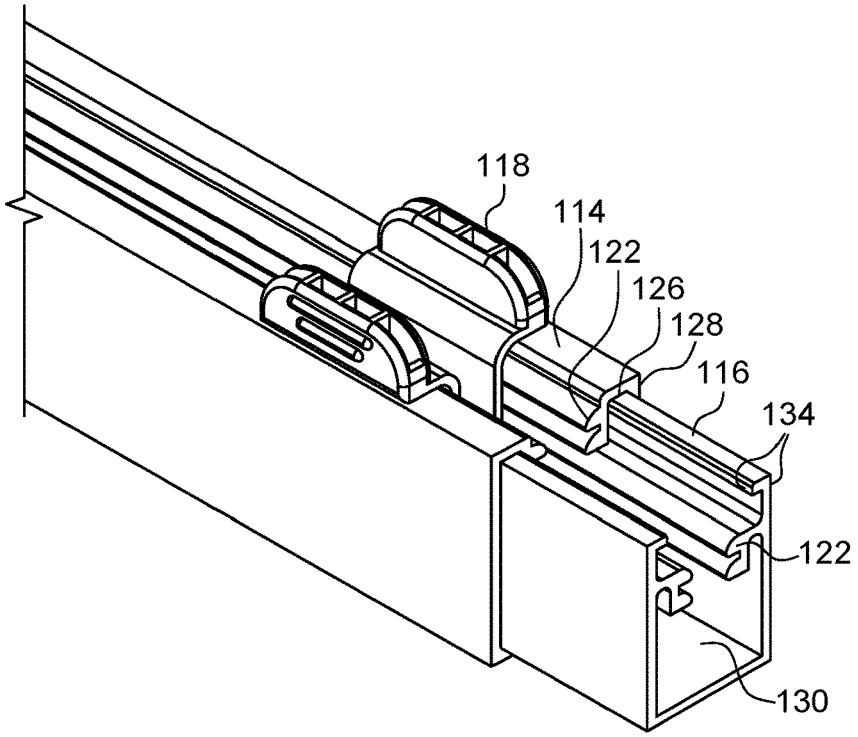
FIG. 5 illustrates a cross-sectional perspective view of an assembly of an inner channel member and an outer channel member with an associated securing tab of the invention.

FIG. 5 illustrates a cross-sectional perspective view of an assembly of an inner channel member 116 and an outer channel member 114 with an associated securing tab 118 positioned therein. This perspective view shows how the second engaging channel 126 of the outer channel member 114 slidably receives the inner channel member 116 therein so that the engaging surfaces of the inner channel member 134 are in slidable contact with the engaging surfaces 128 of the outer channel member 114. The inner channel member 116 slidably extends into the outer channel member 114. The current illustration shows the inner channel member 116 extending into the outer channel member 114 and having a securing tab 118 positioned within the respective channels 114, 116 to bias the inner channel 116 member outward toward the outer channel member 114 to secure the respective channels together and prevent slidable movement therebetween. FIG. 5 also illustrates the general alignment of the light engaging or gripping members 122 when the two channel members 114, 116 are slidably engaged together. In this particular embodiment, the light gripping members 122 are positioned immediately above/below each other at the same distance apart (the tip to tip distance between the opposing gripping members 122). In other embodiments the gripping members 122 of the respective channel members 114, 116 may be positioned at varying widths to allow for receiving and securing various sizes of lights 108 therein.

Figure 6:
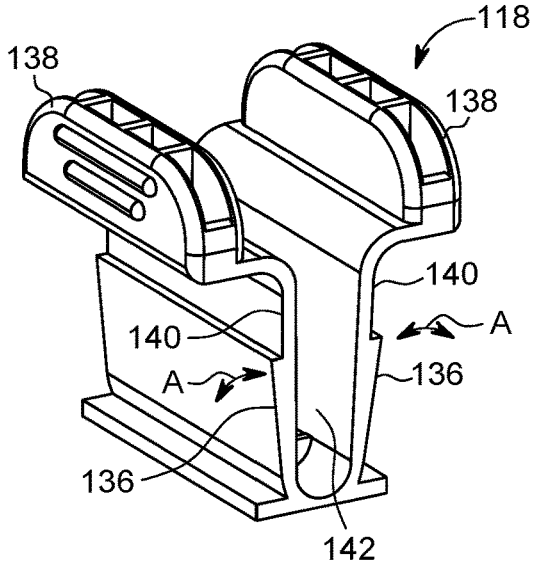
FIG. 6 illustrates a perspective view of a securing tab of the invention.

FIG. 6 illustrates a perspective view of an exemplary securing tab 118. The securing tab 118 generally includes a V shaped configuration having upper handles 138 positioned on each of the terminating ends of the V shape. The upstanding portions 136 of the V shape are generally configured to be flexible so that they may be squeezed together or towards each other via the handles 138. Then, when the handles 138 are released, the upstanding portions 136 of the V shape will travel outward and be able to exert the biasing force described herein. Thus, by actuation of the handles 138, the upstanding biasing members 136 are generally moved in the direction indicated by arrow A. This movement, when the securing tab 118 is positioned with in the respective inner and outer channels 114, 116, generally causes the tab biasing surfaces 140 to push outwardly on the inner channel member 116. This push our bias causes the inner channel member to flex outwardly and contact the outer channel member 116. This contact between the inner and outer channel members 114, 116 causes frictional engagement sufficient to prevent longitudinal or slidable movement between the respective inner and outer channel members 116, 114. The securing tab 118 is optional in the present disclosure, as various methods for securing the inner and outer channels together. For example, a clamp and compression screw combination may be used in place of the securing tab to secure the inner and outer members together.

Figure 7:
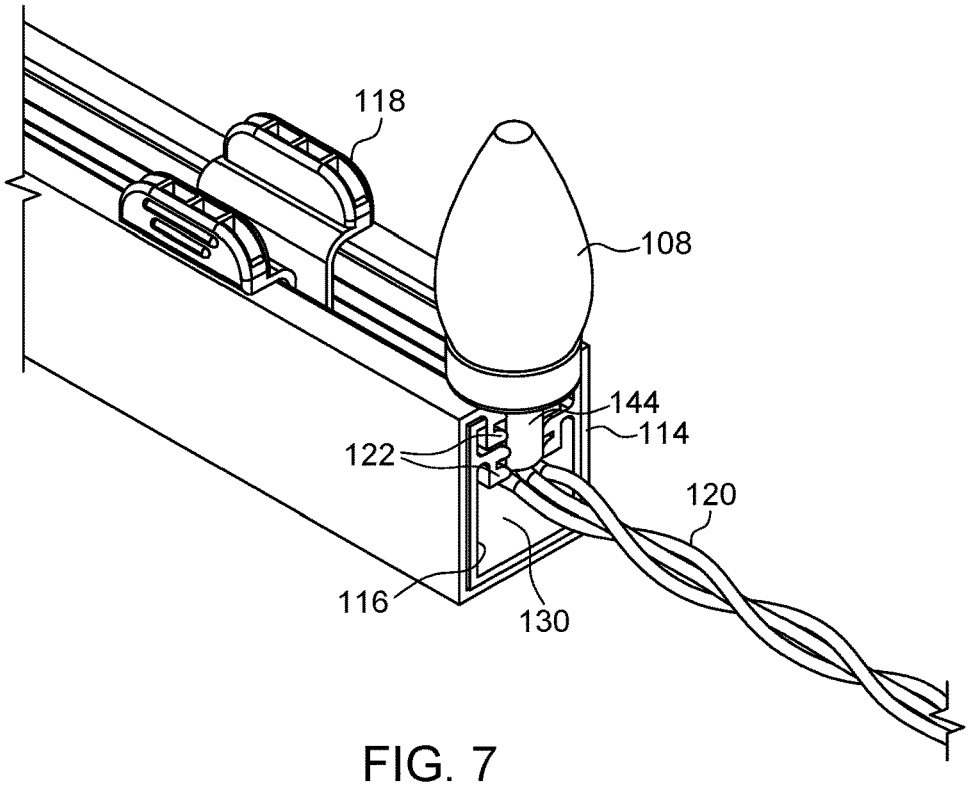
FIG. 7 illustrates a cross-sectional perspective view of an assembly including the inner channel member, the outer channel member, and a light string included therein.

FIG. 7 illustrates a cross-sectional perspective view of an assembly 100 including the inner channel member 116, the outer channel member 114, and a light string 120 included therein. This figure illustrates the light string 120 being positioned in the hollow inner channel portion 130 of the inner channel member 116 and extending longitudinally therethrough to the next light 108 (not shown). This figure also shows that the base of the light 144 being received between and secured by the light engaging or gripping members 122. The gripping members 122 engage the outer surface of the light base 144 to frictionally secure the light 108 and corresponding base 144 to the light frame assembly 100. The light string or wire 120 may be communicated through the entire interior portion of the light assembly 100 via the channel 130. Further, the corner members 106 may also include a hollow central portion 152 allow the light string or wire 122 be communicated through the respective corners 106.

FIG. 8 illustrates a perspective view of corner member 106 used to secure a corner of the light frame 100. The corner member 106 includes a plurality of engagement extensions 146 extending therefrom. The engagement extensions 146 begin at a stop surface 148 and extend longitudinally outward from the corner member 106. The engagement extensions 146 are sized to be received in the second engaging channel 126 of the outer channel member 114. Thus, the corner members 106 are able to be secured to the outer channel member 114 by the engagement extensions 146 being slidably received within the second engaging channel 126 of the outer channel member 114 until the terminating end of the outer channel member 114 abuts the stop surface 148 of the corner member 106. The corner member 106 is configured such that the slidable engagement of the engagement extensions 146 frictionally engages the outer channel member 116 with sufficient force to secure it thereto.

Figure 9:
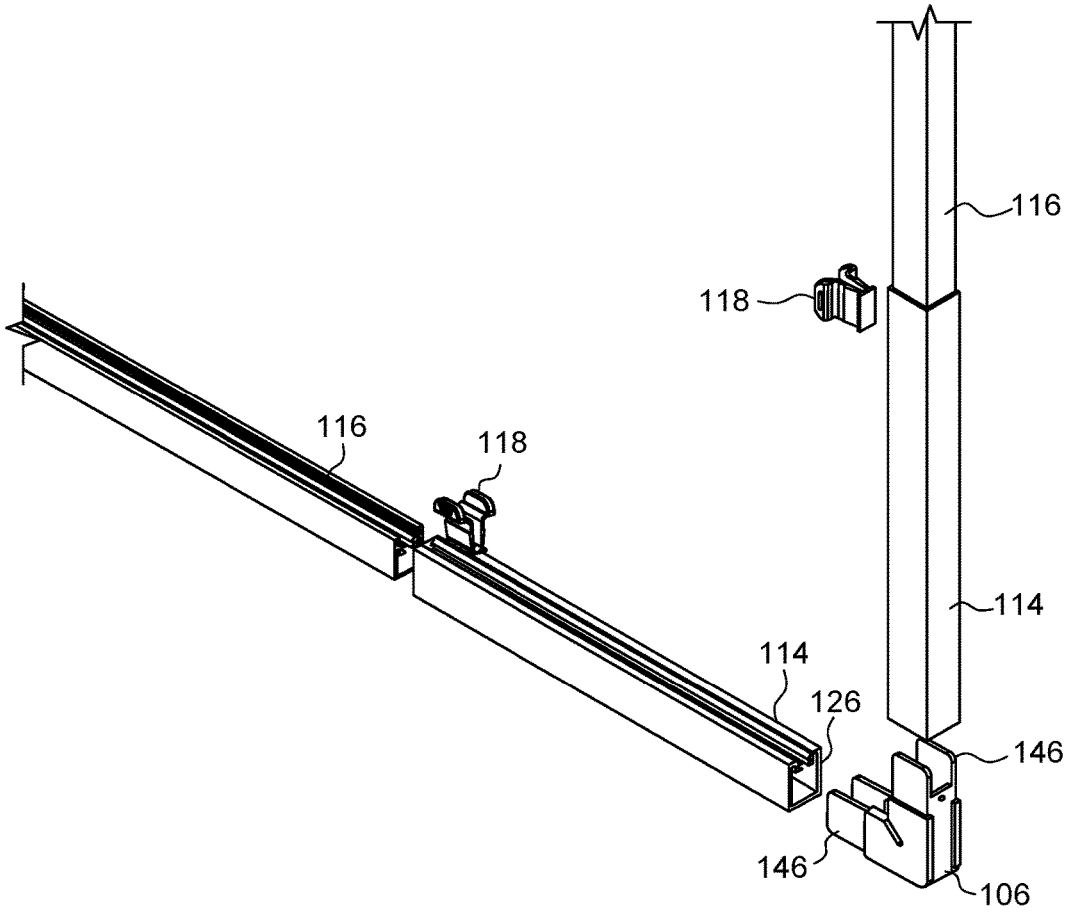
FIG. 9 illustrates a perspective exploded view of a corner of the light frame of the invention.

FIG. 9 illustrates a perspective exploded view of a corner 106 of the light frame 100. This exploded view illustrates the engagement extensions 146 of the corner 106 being inserted into the second engaging channel 126 of the outer channel member 114. Similarly, this figure shows the inner channel member 116 being slidably engaged within the outer channel member 114 so that the securing tab 118 may be inserted there in to secure the respective channel members 114, 116 together. The securing tab 118 may be configured to be inserted into the hollow inner channel portion 130 directly through the gripping members 122. This insertion would generally require squeezing the handles 138 together to reduce the width of the securing tab 118 to a width that is less than the space between the respective gripping members 122. In another embodiment, the securing tab 118 may be slidably received within the respective channel members 114, 116 from a terminating end. In this configuration the securing tab 118 may be slid in a terminating end of the channel members 114, 116 and positioned longitudinally along the channel member at the desired position. Once in position, the handles 138 of the securing tab 118 may be released to exert the outward biasing force that causes the inner channel member 116 to frictionally engage the outer channel member 114 and become frictionally secured thereto so that slidable engagement between the respective channel members 114, 116 is now prevented.

Figure 10:
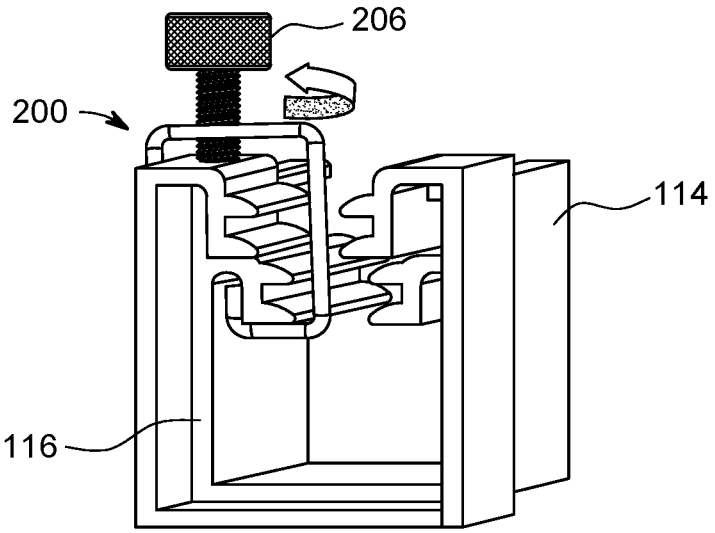
FIG. 10 illustrates a perspective view of a clamping mechanism for the assembly.
Figure 11:
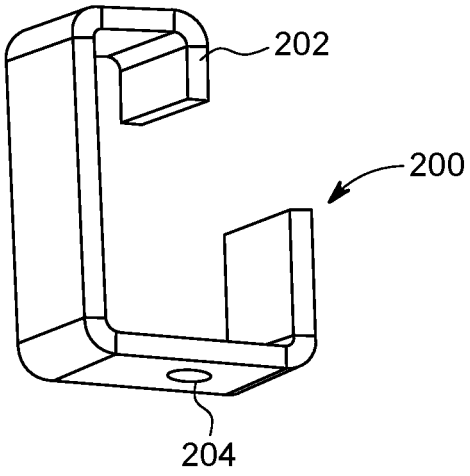
FIG. 11 illustrates a perspective view of the clamp member.

FIG. 10 illustrates a perspective view of an exemplary clamping mechanism for the assembly of the present disclosure. The clamping mechanism 200 generally includes a "C" shaped member 202 that is configured to slide onto a longitudinal end of the assembled channel members 114, 116. The clamp mechanism 200 includes a securing screw 206 threadably attached to a portion thereof so that the securing screw 206 may be rotated to cause an end of the screw 206 to engage the outer member 114 to secure and hold the outer member 114 relative to inner member 116 and prevent slidable movement between the two members 114, 116. FIG. 11 illustrates a perspective view of the clamp member 200 and shows an optional hole 204 formed in a bottom surface of the clamp member 202, wherein said hold 204 may receive a screw therein that may optionally be used to engage against a bottom surface of the channel members 114, 116 to further secure the clamping mechanism 200 to the channel members 114, 116.

Figure 12:
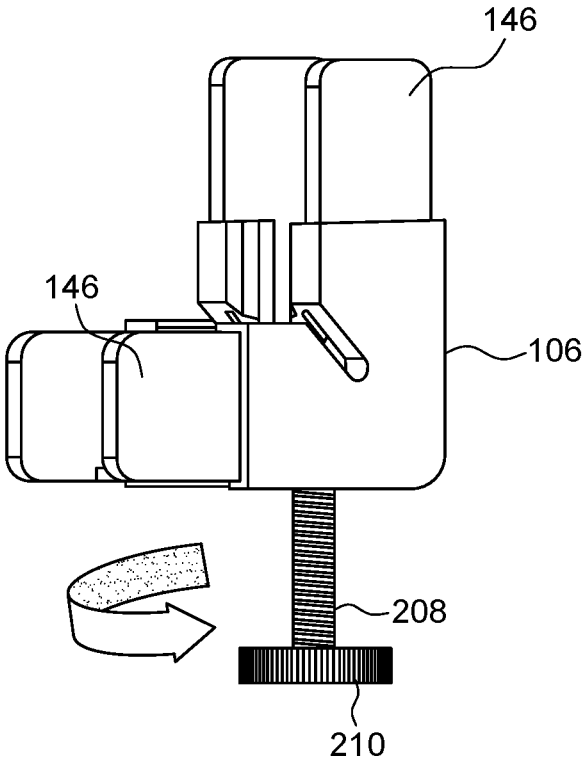
FIG. 12 illustrates a perspective view of a corner member with an elevation screw.

FIG. 12 illustrates a perspective view of a corner member with an elevation screw. The corner members 106 may optionally include a threaded hole formed therein that receives a threaded elevation adjustment screw 208 therein. The threaded elevation adjustment screw may include a knob or enlarged surface area 210 that is sized and configured to support the weight of the entire light assembly. The elevation adjustment screw may be used, for example, to adjust the height of the light assembly when the assembly is sitting on a window frame. For example, if the light holder assembly is placed inside a window on a window sill, then the adjustment screws on the bottom corners of the frame may be rotated to raise the frame until the knob 210 on the top corners engages the ceiling or top of the window frame essentially biasing the light frame into the window frame between the top and bottom surfaces of the frame. The elevation screws 208 allow for the light frame to be positioned inside or outside the window frame, as the light frame is frictionally held in place and does not require any physical attachment to the window frame and will therefore not cause any damage thereto.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A light frame assembly for securing decorative lighting thereto, comprising:

four corner members; and four side member assemblies, the side member assemblies comprising an alternating combination of outer channel members and inner channel members, the outer and inner channel members cooperatively forming a U-shaped or C-shaped channel having an elongated receiving slot that is sized to receive a plurality of light bases therein and to contain an electrical wire connecting each of the light bases, the receiving slot having an equal width longitudinally along each of the inner and outer channel members to allow for placement of the light bases at various positions along the receiving slot, the receiving slot having longitudinally extending gripping members positioned on opposing sides of the receiving slot and sized to engage and secure the light bases there between, the terminating ends of the inner channel members are slidably received into first terminating ends of the outer channel members and second terminating ends of the outer channel members are slidably engaged with the corner members.

2. The light frame assembly of claim 1, further comprising elevation screw members positioned on the corner members.

3. The light frame assembly of claim 2, wherein the elevation screw member comprises a threaded rod having an enlarged surface area, the threaded rod being received in a threaded hole formed into the corner member.

4. The light frame assembly of claim 1, wherein the longitudinally extending gripping members are formed on the outer channel and the inner channel.

5. The light frame assembly of claim 1, wherein the inner channel member is sized and shaped to be slidably received into an inner body portion of the outer channel member.

6. A light frame assembly comprising:

four corner members;

a plurality of outer channel members and a plurality of inner channel members forming horizontal and vertical elongated sides of the light frame assembly, the outer channel members having a hollow inner portion sized to slidably receive the inner channel members therein;

eight terminating ends of the outer channel members being connected to the four corner members;

the outer channel members and inner channel members forming a longitudinally extending light base receiving slot, the slot having a unitary width around a perimeter of the light frame;

the light base receiving slot being defined by elongated gripping members positioned on opposing sides of the light base receiving slot and extending around the perimeter of the light frame, the elongated gripping members being sized to engage and secure a plurality of light bases there between in various positions around the perimeter of the light frame.

7. The light frame assembly of claim 6, further comprising an elevation screw member positioned on at least two of the corner members.

8. The light frame assembly of claim 7, wherein the elevation screw members are positioned on the outer horizontal surface of each of the four corner members, thus providing an elevation screw member on each of the four corners of the light frame assembly, each elevation screw being vertically actuatable to engage a proximate horizontal surface.

9. The light frame assembly of claim 7, wherein the elevation screw members are positioned on the outer vertical surface of each of the four corner members, thus providing an elevation screw member on each of the four corners of the light frame assembly, each elevation screw being horizontally actuatable to engage a proximate vertical surface.

10. A light frame assembly of claim 7, wherein the elevation screw member further comprises a threaded rod that is engaged in a threaded hole formed in the corner member, the threaded rod having an enlarged head on a terminating end thereof.

11. A light frame assembly of claim 6, wherein the clamping members are positioned over the outer portion of the outer channel at each location where the outer channel has an inner channel slidably positioned therein.

* * * * *